United States Patent [19]

Gergoe et al.

[11] Patent Number: 4,602,813

[45] Date of Patent: Jul. 29, 1986

[54] STRIKER ASSEMBLY FOR CLOSURE LID

[75] Inventors: Bela Gergoe, Birmingham; Robert J. Myslicki, Sterling Heights, both of Mich.

[73] Assignee: General Motors Corporation, Detroit, Mich.

[21] Appl. No.: 645,232

[22] Filed: Aug. 29, 1984

[51] Int. Cl.[4] ..... E05B 15/02

[52] U.S. Cl. ..... 292/340; 292/DIG. 43; 292/DIG. 53

[58] Field of Search ..... 292/340, 341, 341.12, 292/341.13, DIG. 43, DIG. 53

[56] References Cited

U.S. PATENT DOCUMENTS

| | | | |
|---|---|---|---|
| 1,323,755 | 12/1919 | Gogay | 292/340 |
| 1,822,424 | 9/1931 | Scott | 292/340 |
| 1,980,295 | 11/1934 | Schnell | 292/340 |
| 1,987,513 | 1/1935 | Lindberg | 292/340 |
| 2,162,673 | 6/1939 | Johnson et al. | 292/340 |
| 2,647,780 | 8/1953 | Knuth | 292/340 |
| 2,683,054 | 7/1954 | Earman | 292/340 |
| 3,563,588 | 2/1971 | Putsch | 292/340 X |
| 4,076,294 | 2/1978 | Holmberg | 292/340 |
| 4,186,476 | 2/1980 | Mair et al. | 29/407 |

FOREIGN PATENT DOCUMENTS

| | | | |
|---|---|---|---|
| 12808 | of 1908 | United Kingdom | 292/340 |
| 388106 | 2/1933 | United Kingdom | 292/340 |

*Primary Examiner*—Robert L. Wolfe

*Assistant Examiner*—Lloyd A. Gall

*Attorney, Agent, or Firm*—Charles E. Leahy

[57] ABSTRACT

A striker assembly includes a reinforcement bracket having a threaded stud, a receptacle, and laterally spaced-apart opposed-facing cam shoulders. The reinforcement bracket is welded onto the vehicle body rear panel with the threaded stud at a precise vertical and transverse location determined by a locating fixture which seats against the compartment lid opening of the vehicle body. A striker bracket has the striker rod mounted thereon, an end which fits within the receptacle of the reinforcement bracket, and an aperture which fits over the threaded stud. Flanges bent from the striker bracket define cam faces which overlie the cam shoulders of the reinforcement bracket. As a nut is threaded onto the threaded stud, the striker bracket is forced into overlying engagement with the reinforcement bracket. The fit between the end of the striker bracket and the receptacle of the reinforcement bracket shifts the striker bracket in the direction to always maintain a contact between the threaded stud and the wall of the striker bracket aperture so that the striker rod carried by the striker bracket is precisely located in the vertical direction by the threaded stud. Simultaneously, the cam flanges of the striker bracket are forcibly seated on the cam shoulders of the reinforcement bracket to precisely locate the striker rod transversely with respect to the precise transverse location of the reinforcement bracket.

4 Claims, 7 Drawing Figures

STRIKER ASSEMBLY FOR CLOSURE LID

The invention relates to a striker assembly for a closure lid and more particularly an improved striker for a vehicle body compartment lid having a striker reinforcement and a striker bracket.

BACKGROUND OF THE INVENTION

Motor vehicle closure panels, such as rear compartment lids, are conventionally latched in the closed position by a latch assembly which is mounted on the compartment lid and has a fork bolt which engages with a striker rod mounted on the rear panel of the compartment. When the compartment lid is closed, the fork bolt pivots to a latched position engaging the striker rod to establish the closed position of the compartment lid.

U.S. Pat. No. 4,186,476 by Alex C. Mair et al, issued Feb. 5, 1980, disclosed a method for the precise fitting of motor vehicle front end sheet metal in which the striker was precisely mounted on the vehicle hood with respect to the outer appearance surfaces of the hood and the latch was precisely located on the vehicle body with repect to the appearance surfaces of the vehicle body opening to be closed by the hood. Thus, when the hood was closed the striker and latch would cooperate to predictably position the hood at a precise height and transverse location which would precisely align and center the hood in the opening.

Heretofore the construction of the striker rod has comprised a bent striker rod which is welded to a mounting bracket. That mounting bracket is then welded in the center of the sheet metal panel which is to become the rear wall of the luggage compartment. Thus, after the vehicle body is welded together from the various sheet metal components, the striker rod is in place at the rear wall of the luggage compartment. Then the vehicle body is painted and the inside of the luggage compartment is treated with various spray dispensed sealers, sound deadeners, and paints to provide a water-tight and aesthetically pleasing luggage compartment.

Thus, a disadvantage of the conventional striker assembly is that the surface of the striker rod can be fouled by sealers, sound deadeners and paints so that the engagement thereof by the fork bolt of the latch assembly may not be consistently reliable and will chip away the paint. Another disadvantage is that the striker rod cannot be predictably located relative to the compartment lid opening so that the mounting position of the latch assembly on the compartment lid must be adjusted through trial and error to properly latch with the striker rod.

The present invention provides a new and improved striker assembly which facilitates accurate location on the rear wall and is also capable of final assembly subsequent to application of paint, sealers and sound deadeners so that the striker rod does not become fouled.

SUMMARY OF THE INVENTION

According to the invention, a striker assembly includes a stamped steel reinforcement bracket adapted for spot welded attachment to the rear wall of the vehicle body and having a threaded stud, a receptacle spaced from the stud, and laterally spaced-apart opposed-facing cam shoulders. The reinforcement bracket is welded onto the previously assembled vehicle body rear panel at a precise lateral location which is determined by a locating fixture which seats against the rear quarter panel flanges defining the outer appearance surfaces of the compartment lid opening and precisely locates the threaded stud vertically and laterally. The striker assembly also includes a striker bracket having the striker rod mounted thereon. The striker bracket has an end adapted to fit within the receptacle and an aperture adapted to fit over the threaded stud. Flanges bent from the striker bracket define cam faces which overlie the opposed-facing cam shoulders of the reinforcement bracket. As a nut is threaded onto the threaded stud, the striker bracket is forced into overlying engagement with the reinforcement bracket. The fit between the end of the striker bracket and the receptacle of the reinforcement bracket shifts the striker bracket in the direction to always maintain a contact between the threaded stud and the wall of the striker bracket aperture so that the striker rod carried by the striker bracket is precisely located in the vertical direction by the threaded stud. Simultaneously, as the striker bracket is forcibly pivoted into the overlying position on the reinforcement bracket, the cam flanges of the striker bracket are forcibly seated on the opposed-facing cam shoulders of the reinforcement bracket to precisely locate the striker rod laterally with respect to the predetermined precise lateral location of the reinforcement bracket.

DESCRIPTION OF THE PREFERRED EMBODIMENT

Figure 1:
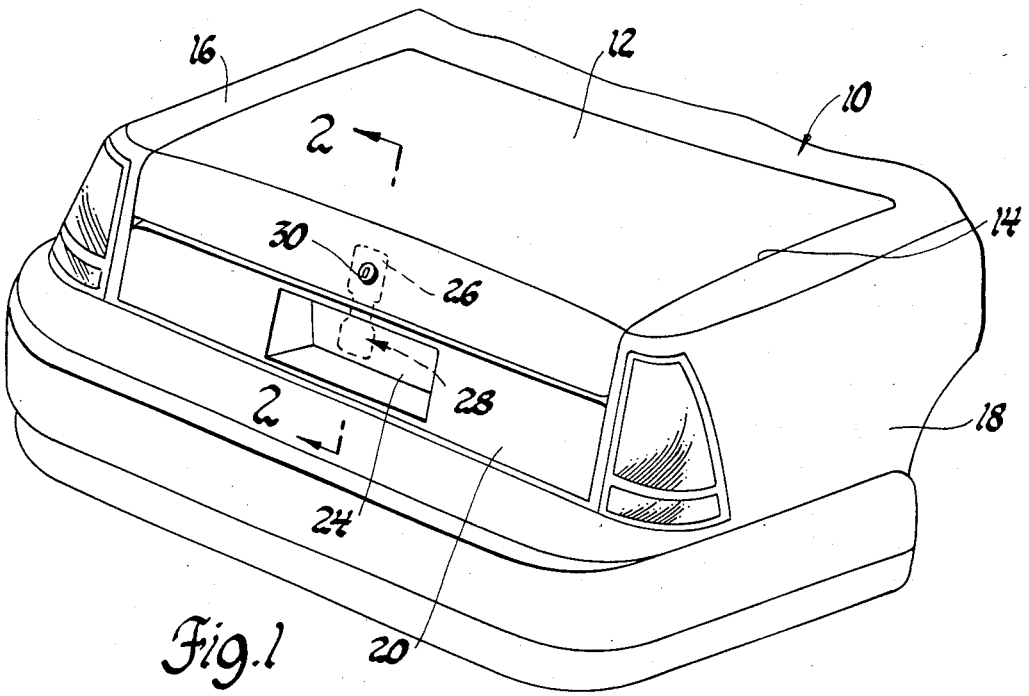
FIG. 1 is a perspective view of the rear end of a vehicle body having a compartment lid latched in the closed position by a striker assembly according to this invention.
Figure 2:
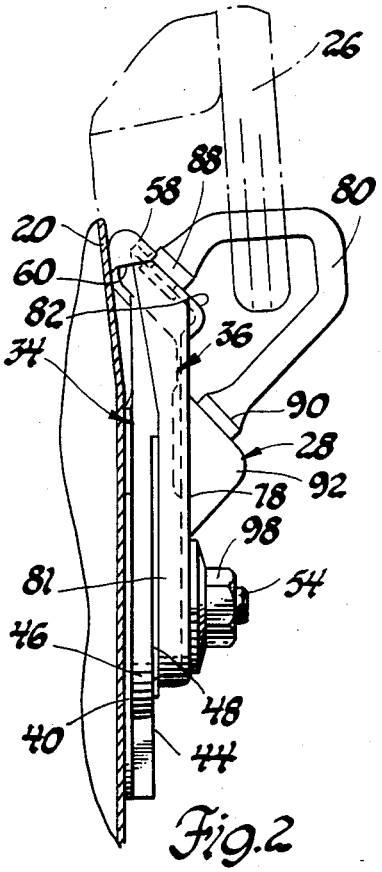
FIG. 2 is a view taken in the direction of arrows 2—2 of FIG. 1.

According to FIG. 1, there is shown the rear end of a motor vehicle body 10 having a compartment lid 12 which is hingedly mounted for opening and closing movement with respect to a compartment lid opening 14 through which access may be had to a luggage compartment. The luggage compartment and the closure opening are defined by left quarter panel 16, right quarter panel 18 and a rear panel 20 which are welded together. The rear panel 20 may have an indented central portion 24 which conveniently mounts a license plate. A latch assembly 26 is mounted on the compartment lid and has a forked latch bolt which engages with a striker assembly 28 mounted on the rear panel 20 to latch the compartment lid 12 in the closed position of FIG. 1. The latch assembly 26 is operated by a key cylinder 30. The striker assembly 28 is conveniently mounted on the indented central portion 24 of the rear panel 20.

Figure 3:
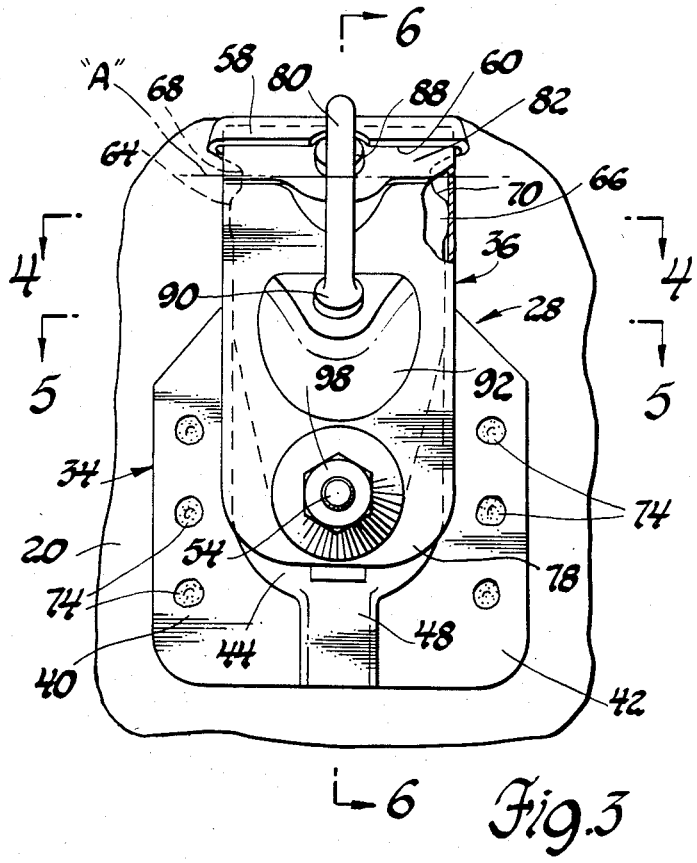
FIG. 3 is a frontal elevation view of the striker assembly.
Figure 6:
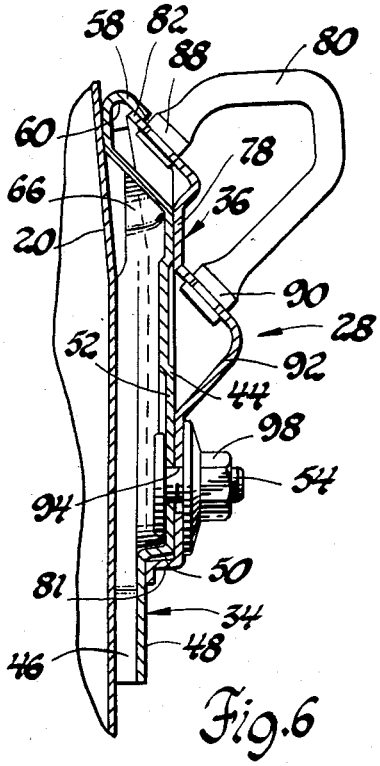
FIG. 6 is a sectional view taken in the direction of arrows 6—6 of FIG. 3.
Figure 7:
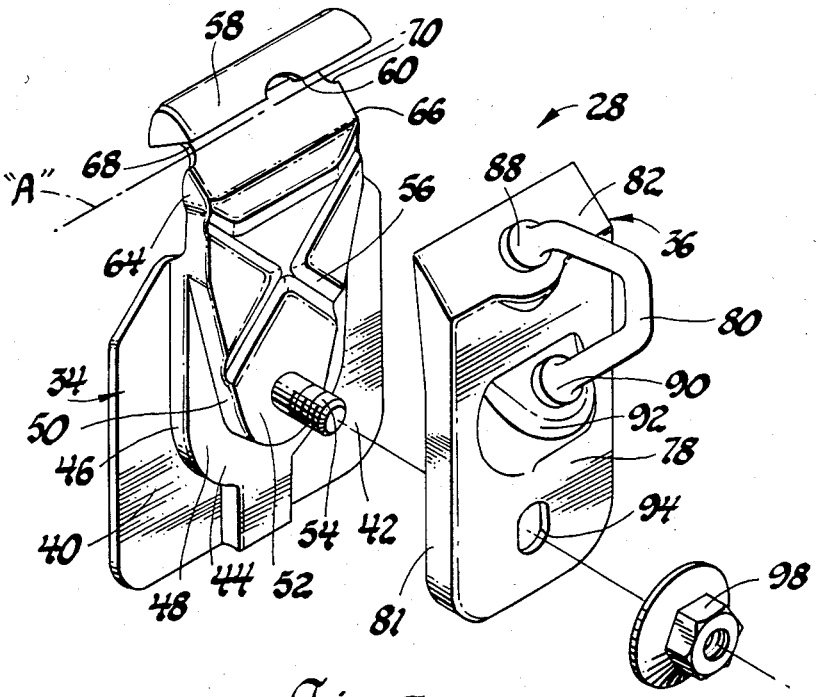
FIG. 7 is an exploded perspective view showing the reinforcement bracket and the striker bracket of the striker assembly.

The present invention relates to a new and improved striker assembly shown in FIGS. 2–7. The striker assembly 28 includes a striker reinforcement bracket 34 and a striker bracket 36. As best seen in FIG. 7, the striker reinforcement 34 is a sheet metal stamping which generally includes laterally extending mounting base walls 40 and 42 and a raised boss 44. The raised boss 44 includes a first step defined by a riser 46 and landing 48 and a second step defined by a riser 50 and a landing 52. A threaded stud 54 is press fit into the reinforcement plate 34 and projects from the landing 52. Landing 52 has reinforcing dimples 56 defined therein. The upper end of the reinforcement bracket 34 has a reversely bent portion 58 which defines a downwardly opening receptacle 60 as best seen in FIG. 6. As best seen in FIG. 3, the reinforcement plate 34 has a pair of spaced apart oppositely facing cam shoulders 64 and 66. Just above these cam shoulders 64 and 66, the reinforcement 34 is scalloped at 68 and 70 to define a transversely extending axis "A" about which the reversely bent portion 58 defining receptacle 60 may yield slightly relative to the raised boss 44.

Referring to FIG. 3, it will be understood that the striker reinforcement 34 is mounted upon the rear wall 20 of the vehicle body by spot welds 74. The mounting location of the striker reinforcement 34 is determined by a locating fixture which rests against the walls of the rear quarter panels 16 and 18 defining the compartment lid opening 14. The locating fixture functions to center the threaded stud 54 laterally within the compartment lid opening so that the spot welds 74 will attach the striker reinforcement 34 with the threaded stud 54 at the exact center of the compartment lid opening 14 and at a precise vertical height.

The striker bracket 36 is comprised of a sheet metal striker plate 78 which carries a striker rod 80. The striker plate 78 has a flange or skirt 81 which depends from the edges thereof to stiffen the striker base 78. The top end of the striker plate 78 is defined by an angled wall 82. The striker rod 80 is a piece of round stock which is bent into the desired shape and has its ends 88 and 90 respectively staked to the angled end wall 82 of the striker base 78 and to a raised embossment 92 of the striker base 78. Striker base 78 also has an aperture 94 which is adapted to fit over the threaded stud 54. The striker 36 is preferably zinc plated to provide a resistance to corrosion and also provide a hard wearing surface on the striker rod 80 to resist its wear by the fork bolt of the latch assembly 26 when the compartment lid 12 is opened and closed.

At some time after the striker reinforcement 34 has been welded onto the rear panel 20, the vehicle body will be painted. In addition, sealers are dispensed into the luggage compartment to seal the seams between sheet metal panels in order to ensure a moisture tight compartment. Sound deadeners are also sprayed into the compartment or other appropriate surface treatment such as paints are applied. These coatings are applied on the striker reinforcement 34. The threads of the threaded stud 54 are preferably precoated with a release material which will prevent the paint or the materials from interfering with the threads. The reversely bent wall 58 at the top edge of the striker reinforcement 34 provides some shielding of the receptacle 60 against being clogged with paint, sealers or deadeners.

Figure 4:
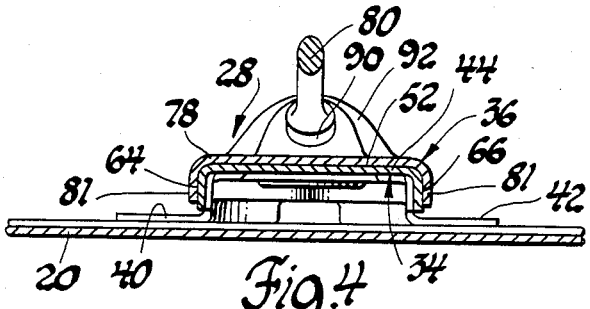
FIG. 4 is a sectional view taken in the direction of arrows 4—4 of FIG. 3.
Figure 5:
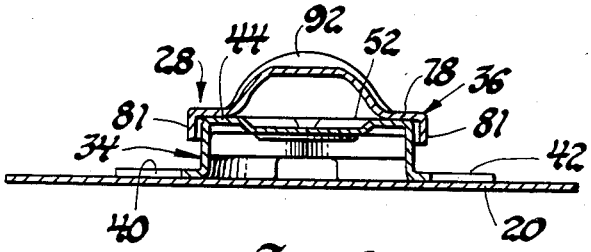
FIG. 5 is a sectional view taken in the direction of arrows 5—5 of FIG. 3.

At some time after the body has been completely painted, the striker bracket 36 is assembled to the striker reinforcement 34. This assembly operation is achieved by first inserting the angled end wall 82 of the striker 36 into the receptacle 60 and then pivoting the bottom of the striker bracket 36 downwardly to fit the aperture 94 over the threaded stud 54. As best seen in FIG. 6, the dimensions between the receptacle 60 and the threaded stud 54 is such that the top edge of the aperture 94 is engaged against the topside of the threaded stud 54 so that the vertical location of the threaded stud determines the vertical location of the striker rod 80. As the threaded nut 98 is forcibly screwed onto the threaded stud 54, the striker base 78 is forcibly seated onto the land 52 of the striker reinforcement 34. The fit between the angled end wall 82 and the reversed bent portion 58 is such that the striker bracket 36 is shifted downwardly to maintain the contact between the top edge of aperture 94 and the topside of the threaded stud 54. Simultaneously the flanges 81 at the side edge of the reinforcement base 78 are forcibly cammed over the opposed-facing cam shoulders 64 and 66 as best shown in FIG. 4 to center the striker 36 with respect to the previously centered reinforcement plate 34. The reversely bent portion 58 defining receptacle 60 may yield somewhat about axis "A" to accommodate the forced movement of the striker bracket 36 into overlying engagement with the striker reinforcement 34.

Thus it is seen that the invention provides a new and improved striker assembly for a closure lid. The striker rod itself is zinc plated and can be assembled within the luggage compartment after the luggage compartment has been treated with sealers, sound deadeners and paints so that the striker rod has a wear-resistant zinc coating and the problem of paint chipping from the striker rod is eliminated and the problem of the striker rod being fouled by the sealers and sound deadeners is also eliminated. Furthermore the striker reinforcement is welded to the vehicle body panel by a positioning fixture which locates the threaded stud at a precise location both transversely within the compartment lid opening and at a precise vertical distance within the compartment lid opening. The striker bracket is designed so that it consistently locates with respect to the threaded stud of the striker reinforcement so that the striker rod will also be precisely located with respect to the compartment lid opening.

Thus it is seen that the invention provides a new and improved striker assembly.

The embodiments of the invention in which exclusive property or privilege is claimed are defined as follows:

1. A striker assembly mounted on a vehicle body for engagement by a closure latch to hold a hingedly mounted closure lid panel in a closed position closing a vehicle compartment defined by a compartment body panel, said striker assembly comprising:

a striker reinforcement adapted for attachment on one of the panels inside the vehicle compartment and having a threaded stud projecting therefrom into the compartment, receptacle vertically spaced from the stud, and cam means spaced from and intermediate the stud and the receptacle;

a striker bracket having a striker rod mounted thereon and adapted to overlie the reinforcement bracket and extend into the compartment, said striker bracket having an end adapted to fit within the receptacle of the striker reinforcement, a wall defining an aperture oversized in the vertical direction with respect to the size of the stud and adapted to receive the stud, and means thereon adapted to coact with the cam means of the reinforcement bracket;

a threaded nut adapted to be driven onto the threaded stud whereby the striker bracket is forcibly seated into overlying relationship of the striker reinforcement at a precisely mounted location by the cooperation of the stud engaging the wall of the aperture, the end of the striker bracket engaging the receptacle, and the cam means of the striker bracket acting against the coacting means of the striker reinforcement to thereby fix the striker bracket against rotation about the stud and define a precise lateral and vertical location of the striker rod.

2. A striker assembly mounting a striker rod on a vehicle body for engagement by a closure latch to hold a hingedly mounted closure lid panel in the closed position closing a vehicle compartment defined by a compartment body panel, said striker assembly comprising:

a striker reinforcement attached on one of the panels inside the vehicle compartment and having a threaded stud projecting therefrom into the compartment at a precise vertical location and cam means having a precise transverse location;

a striker bracket having the striker rod mounted thereon extending into the compartment and having a wall defining an aperture oversized in the vertical direction with respect to the size of the stud and adapted to receive the threaded stud, and cam means thereon adapted to coact with the cam means of the striker reinforcement; and a threaded nut adapted to be driven onto the threaded stud whereby the striker bracket is forcibly seated into overlying relationship of the striker reinforcement with the striker bracket and the striker rod carried thereon being precisely vertically mounted by the stud engaging the wall of the aperture and being precisely transversely mounted by the cam means of the striker bracket and striker reinforcement acting against one another, thereby fixing the striker bracket against rotation about the stud.

3. A striker assembly mounted on a vehicle body for engagement by a closure latch to hold a hingedly mounted closure lid panel in a closed position closing a vehicle compartment defined by a compartment body panel, said striker assembly comprising:

a striker reinforcement bracket adapted for attachment on one of the panels inside the vehicle compartment and having a threaded stud projecting therefrom into the compartment and a receptacle vertically spaced from the stud;

a striker bracket having a striker rod mounted thereon and adapted to overlie the striker reinforcement bracket and extend into the compartment, said striker bracket having a portion adapted to fit within the receptacle of the striker reinforcement bracket and an aperture oversized in the vertical direction with respect to the size of the stud and adapted to receive the stud;

a threaded nut adapted to be driven onto the threaded stud whereby the striker bracket is forcibly seated into overlying relationship of the striker reinforcement bracket with the striker rod being precisely located vertically by the stud engaging the wall of the aperture; and cam means provided on at least one of the brackets and engaging the other bracket to thereby fix the striker bracket against rotation about the stud and establish a precise transverse location of the striker bracket relative to the striker reinforcement bracket.

4. A striker assembly mounted on a vehicle body for engagement by a closure latch to hold a hingedly mounted closure lid panel in a closed position closing a vehicle compartment defined by a compartment body panel, said striker assembly comprising:

a striker reinforcement adapted for attachment on one of the panels inside the vehicle compartment and having a threaded stud projecting therefrom into the compartment, a pair of laterally spaced apart oppositely facing cam shoulders and a receptacle vertically spaced from the stud and defined by a reversely bent portion of the reinforcement bracket;

a striker bracket having a striker rod mounted thereon extending into the compartment, and having a wall defining an aperture oversized in the vertical direction with respect to the size of the stud and adapted to receive the threaded stud, an end portion adapted to fit within the receptacle of the striker reinforcement, and laterally spaced flange portions adapted to coact with the laterally spaced apart oppositely facing cam shoulders of the striker reinforcement;

and a threaded nut adapted to be driven onto the threaded stud whereby the striker bracket is forcibly seated into overlying relationship of the striker reinforcement with the engagement of the striker bracket end portion with the receptacle forcing the striker bracket into precisely locating engagement with the threaded stud to locate the striker rod precisely in the vertical direction and simultaneously forcibly seat the flange portions of the striker bracket into engagement with the laterally spaced apart oppositely facing cam shoulders of the striker reinforcement to thereby fix the striker bracket against rotation about the stud and precisely locate the striker rod transversely relative to the vehicle body.

* * * * *